United States Patent [19]

Crocker et al.

[11] 4,278,530

[45] Jul. 14, 1981

[54] PROCESS FOR SEPARATING BITUMEN FROM A BITUMEN SAND DEPOSIT

[75] Inventors: Zenas Crocker, Westmount; Wilford B. Jonah, Nobleton, both of Canada

[73] Assignee: Synergistics Chemicals Limited, Concord, Canada

[21] Appl. No.: 63,867

[22] Filed: Aug. 6, 1979

[51] Int. Cl.[3] ..... B03B 1/00

[52] U.S. Cl. ..... 209/3; 209/173; 208/11 R

[58] Field of Search ..... 209/3, 4, 173; 208/11 R

[56] References Cited

U.S. PATENT DOCUMENTS

| | | | |
|---|---|---|---|
| 3,266,738 | 8/1966 | Goeser et al. | 241/98 |
| 4,133,742 | 1/1979 | Hill | 208/11 R |
| 4,187,167 | 2/1980 | Haylik et al. | 208/11 R X |

*Primary Examiner*—William A. Cuchlinski, Jr.

*Attorney, Agent, or Firm*—Larson and Taylor

[57] ABSTRACT

A process is disclosed for separating bitumen from a bitumen tar deposit. The process is a mechanical separation process which is simple, economical and yet does not require high energy consumption. The bitumen sand deposit includes sand particles with coating of bitumen thereon. The process comprises the steps of feeding the bitumen sand deposit and a dispersing medium into an enclosed container having a plurality of arms therein, adapted to rotate about a central axis, each arm having a blade at the end thereof, rotating the plurality of arms, striking and impelling the sand particles to impact on internal surfaces of the blades and container and with other particles, the blades having sufficient tip speed to cause separation of the bitumen coatings from the particles, discharging the sand particles, bitumen and dispersing medium from the container, and collecting the bitumen separately from the sand particles and dispersing medium.

5 Claims, 1 Drawing Figure

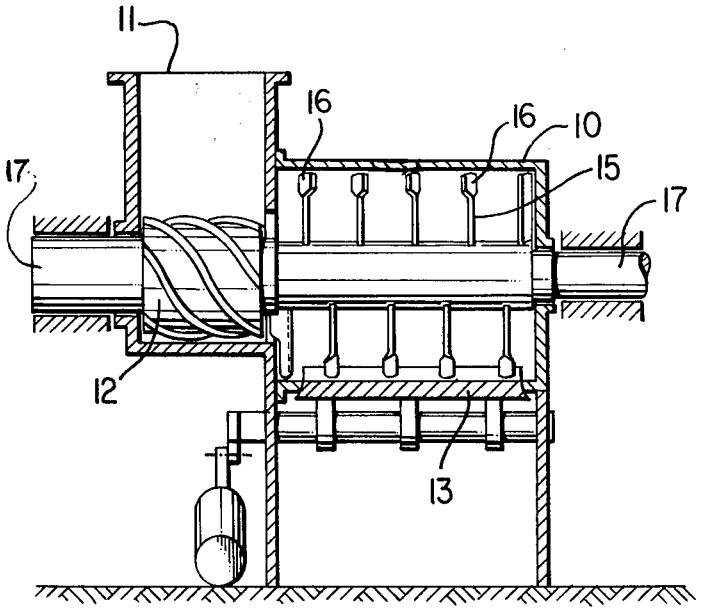
11
16
16
10
15
17
17
12
13

PROCESS FOR SEPARATING BITUMEN FROM A BITUMEN SAND DEPOSIT

This invention relates to a process for separating bitumen from a bitumen sand deposit. More specifically, the invention relates to a mechanical separation process which may be used in the recovery of bitumen, and hence oil, from bitumen sand deposits such as those found in Alberta, Canada, known as the Athabasca tar sands.

Tar sand resources are known to exist in many parts of the world. These resources contain considerably more oil than the more conventional liquid oil reserves known to exist in the rest of the world. However, difficulties have always existed in separating this tar or bitumen coating from the particles of sand and other inorganic material.

It is a purpose of the present invention to provide a process for the recovery of bitumen from tar sands or bitumen sand deposits which is simple, economical, and yet does not require high energy consumption.

The present invention utilizes a mechanical separation process in the presence of a dispersing medium. The particular equipment used with this process is referred to in the plastics industry as a high intensity mixer, i.e. a mixer with tip speeds greater than 10 meters/second. The utilization of a high intensity mixer for high speed agitation of bitumen sand deposits in the presence of a dispersing medium has unexpected results in that the coating of bitumen is quickly stripped from the sand, and the sand particles, bitumen and dispersing medium all form separate phases which can easily be individually collected by normal separating devices, such as filtration, floatation, settling techniques, etc.

In the specification "dispersing medium" includes water or any suitable liquid or solid medium from which the stripped bitumen can be separated.

The present invention provides a process for separating bitumen from a bitumen sand deposit, including sand particles having coatings of bitumen thereon, comprising the steps of: feeding bitumen sand deposit and a dispersing medium into an enclosed container, having a plurality of arms therein, adapted to rotate about a central axis, each arm having a blade at the end thereof, rotating the plurality of arms, striking and impelling the sand particles to impact on internal surfaces of the blades and container and with other particles, the blades having sufficient tip speed to cause separation of the bitumen coatings from the particles, discharging the sand particles, bitumen and dispersing medium from the container, and collecting the bitumen separately from the sand particles and dispersing medium.

In a drawing which illustrates one embodiment of a high intensity mixer, a longitudinal sectional view of a high intensity mixer is shown.

Referring to the drawing, a high intensity batch mixer 10 is shown with an entry trough 11 having a screw feed 12 therein. The high intensity mixer 10 has a hinged discharge flap 13 at its base thereof. Cutting and mixing arms 15, blades 16 at the end thereof are arranged along a shaft 17 which is an extension of the screw feed 12. The shaft 17 is rotated at a high tip speed such as approximately 30 meters per second from a suitable motor.

The drawing illustrates one embodiment of a high intensity mixer which is commerically available and known as a Drais-Gelimat high intensity mixer, manufactured by Draiswerke GMBH. Such a mixer is disclosed in U.S. Pat. No. 3,266,738, published Aug. 16, 1966 by Goeser et al. Whereas this particular mixer is charged by batch, has a screw feed, and rotates continuously, some mixers have a charge flap directly above the discharge flap and are started and stopped for each batch. In other instances the mixer has a continuous feed entrance and a continuous discharge exit.

In one embodiment, a high intensity mixer was set up having a temperature sensing system such as that disclosed in co-pending application 962,778, filed Nov. 21, 1978. In this process the batch temperature is monitored separately from the mixer temperature, and the batch is discharged from the mixer when the batch temperature reaches a final predetermined level. The speed of the rotating shaft was such that the tip speed of the blades was 31 meters per second. A bitumen sand deposit was obtained having a % weight breakdown of 15% bitumen, 0.7% water and 83.4% solids leaving a 0.9% discrepancy. Weighed amounts of the bitumen sand deposit were fed into the high intensity mixer along with weighed amounts of tap water. Immediately upon initiating the mixing step, water along with bitumen globules and clean sand leaked either continually or at a continuous rate from the high intensity mixer and were found to be in a separated phase.

Upon discharge of the balance of the batch in less than 30 seconds, it was found that with light agitation in additional tap water, bitumen globules floated to the top and a clean sand remained at the bottom of the catching beaker. In this catching beaker there were three phases, bitumen globules on top, clear 40° C. water in the middle and clean sand on the bottom. The bitumen globules were easily removed from the water by skimming and represented over 98% recovery of the bitumen available in the original batch. Further tests of the discharge in the beaker demonstrated that even after vigorous agitation, the three phases immediately separated.

Various changes may be made to the scope of the present application without departing from the spirit of the invention which is only limited by the claims.

The embodiments of the invention in which an exclusive property or privilege is claimed are defined as follows:

1. A process for separating bitumen from a bitumen sand deposit including sand particles having coatings of bitumen thereon, comprising the steps of:

feeding bitumen sand deposit and a dispersing medium into an enclosed container having a plurality of arms therein, adapted to rotate about a central axis, each arm having a blade at the end thereof, rotating the plurality of arms, striking and impelling the sand particles to impact on internal surfaces of the blades and container and with other particles, the blades having sufficient tip speed to cause separation of the bitumen coatings from the particles, without further treatment thereof, discharging the sand particles, bitumen and dispersing medium from the container, and collecting the bitumen separately from the sand particles and dispersing medium.

2. The process according to claim 1 wherein a batch of bitumen sand deposit is fed individually into the enclosed container and remains in the container for less than 30 seconds.

3. The process according to claim 1 wherein the tip speed is approximately 30 meters/second.

4. The process according to claim 1 wherein the dispersing medium is water.

5. The process according to claim 4 wherein the sand particles, bitumen and water are discharged from the container into water.

* * * * *